US006755310B1

(12) United States Patent
Hilton et al.

(10) Patent No.: US 6,755,310 B1
(45) Date of Patent: Jun. 29, 2004

(54) CAN DISPENSER

(76) Inventors: Whit Hilton, 199 Bachelor St., Granby, MA (US) 01033; Nancy Hilton Usher, 102 Dartmouth St., Holyoke, MA (US) 01040

( * ) Notice: Subject to any disclaimer, the term of this patent is extended or adjusted under 35 U.S.C. 154(b) by 0 days.

(21) Appl. No.: 10/345,429

(22) Filed: Jan. 17, 2003

(51) Int. Cl.[7] ..... A47F 1/08; A47B 47/00

(52) U.S. Cl. ..... 211/59.2; 211/49.1; 211/194; 211/78

(58) Field of Search ..... 211/59.2, 49.1, 211/194, 77, 78, 163; 312/43, 45, 125

(56) References Cited

U.S. PATENT DOCUMENTS

| | | | | | |
|---|---|---|---|---|---|
| 1,759,140 | A | * | 5/1930 | Silberger | 211/77 |
| 1,807,400 | A | | 5/1931 | Gallagher | |
| 2,212,129 | A | | 8/1940 | Rust | |
| 2,221,704 | A | | 11/1940 | Farley | |
| 2,670,853 | A | | 3/1954 | Schneider | |
| 3,316,040 | A | * | 4/1967 | McGann | 312/45 |
| 4,143,765 | A | * | 3/1979 | Moss, III | 211/78 |
| 4,144,662 | A | | 3/1979 | Drexler | |
| D263,528 | S | * | 3/1982 | Gunnigle | D6/457 |
| 4,842,149 | A | | 6/1989 | Vining | |
| 4,889,245 | A | * | 12/1989 | Rinke | 211/49.1 |
| 5,147,119 | A | * | 9/1992 | Harris | 211/59.2 |
| 5,183,165 | A | | 2/1993 | Acona et al. | |
| 5,415,277 | A | * | 5/1995 | Berntsen | 206/144 |
| D399,394 | S | * | 10/1998 | Rapaz | D7/590 |
| D402,838 | S | * | 12/1998 | Sherbet | D6/515 |
| 5,862,943 | A | * | 1/1999 | Larit | 312/45 |
| 6,585,119 | B2 | * | 7/2003 | Palder | 211/49.1 |

* cited by examiner

*Primary Examiner*—Daniel P. Stodola
*Assistant Examiner*—Erica B Harris
(74) *Attorney, Agent, or Firm*—John H. Crozier

(57) ABSTRACT

In a preferred embodiment, a can dispenser, including: a housing with a base unit and one or more stacking units removably disposed on the base unit, the base unit and the one or more stacking units defining together a plurality of vertical, arcuate, can-containing channels therein; edges of the vertical, arcuate, can-containing channels in the base unit extending to less than diameters of cans in the vertical, arcuate, can-containing channels so that the cans can be removed therefrom; and edges of the vertical, arcuate, can-containing channels in the one or more stacking units extending past diameters of cans in the vertical, arcuate, can-containing channels to hold the cans in place therein.

6 Claims, 9 Drawing Sheets

CAN DISPENSER

BACKGROUND OF THE INVENTION

1. Field of the Invention

The present invention relates to can dispensers generally and, more particularly, but not by way of limitation, to a novel can dispenser that is economically constructed.

2. Background Art

Can dispensing devices are used to conserve cabinet counter space, for example, and to display the cans so that the contents thereof are readily ascertainable. Typically, the can dispensers hold a plurality of cans vertically and have various methods of removing one can from the stacks.

Some known dispensers are described in the following patent documents:

U.S. Pat. No. 1,807,400, issued May 26, 1931, to Gallagher, and titled CUP CONTAINER, describes a cup holder which comprises a plurality of vertical cup-containing tubes rotatingly supported in a base structure, the base structure including a recess defined therein. In use, cups are placed in the cup-containing tubes, with the handles thereof protruding through vertical slots that extend the length of the tubes, and the cups are supported in the tubes by means of pivoting bars disposed at the lower end of the tubes. When it is desired to remove a cup from the bottom of one of the tubes, that tube is aligned with the recess and the bar at the bottom of that tube is rotated out of the way. The bottom cup then is pressed downwardly into the recess, compressing springs therein, and the cup is then removed from the recess.

U.S. Pat. No. 2,212,129, issued Aug. 20, 1940, to Rust and titled CAN RACK, describes, in one embodiment, a can rack comprising a vertical tube of resilient material, tapered such that the bottom is narrower than the top and the tube has an opening that is somewhat less than the diameter of cans to be placed therein. To remove a can, a spring-loaded latch is released and the bottom can drops into a cut-away portion of the tube at the bottom thereof, the cutaway portion having a diameter greater than the diameter of the cans. Release of the latch causes the latch to hold the other cans in place. In another embodiment, the resilient tube is straight-sided and any can may be removed from the tube by pulling on the can such that the resilient sides of the tube are spread apart.

U.S. Pat. No. 2,221,704, issued Nov. 12, 1940, to Farley, and titled HOLDER, describes a holder for a plurality of marbles or the like that comprises a series of slots defined in the periphery of a cylinder. Except for the bottom end of the slots, the edges of the slots are closely spaced. At the lower end of the slots, the edges of the slots are widely spaced. In the plate closing the bottom of the slots are defined a plurality of openings. To remove a marble from a slot, the tube of marbles is raised up by inserting a finger in the opening at the bottom of that slot, such that the bottom marble is within the bottom portion of the slot in which the sides of the slot are widely spaced. The marble is then removed from the slot.

U.S. Pat. No. 2,670,853, issued Mar. 2, 1954, to Schneider, and titled DISPLAY STAND FOR STACKED CONTAINERS, describes a display stand that comprises a plurality of vertical columns having partitions therebetween, the partitions having edges that are closer together than the diameter of the items stacked therein. The topmost item is to be removed from a column.

U.S. Pat. No. 4,144,662, issued Mar. 20, 1979, to Drexler, and titled DISPLAY AND DISPENSER, describes a dispenser for containers of pills or food supplements comprising a rotatable, clear plastic cylinder in which are formed vertical columns to receive the containers. The containers are removed through an opening formed in the bottoms of the columns. An information carrier is placed adjacent the containers in a column to describe what the containers in that column contain.

U.S. Pat. No. 4,842,149, issued Jun. 27, 1989, to Vining, and titled PITCHER DISPENSER, describes a pitcher dispenser comprising a plurality of vertical tubes having slots extending the length thereof for the protrusion of the handles of pitchers stacked therein. The openings in the bottoms of the tubes are partially closed, such that the bottom pitcher can be removed from the bottom of a tube only after raising the other pitchers in that tube.

U.S. Pat. No. 5,183,165, issued Feb. 2, 1993, to Acona et al., and titled KITCHEN STORAGE UNIT, describes a storage device which, in relevant part, comprises a set of pluralities of openings each of which is designed to horizontally hold therein a bottle or a can, for example.

The foregoing devices are in some cases complicated, have moving parts, and are not readily expandable.

Accordingly, it is a principal object of the present invention to provide a can dispenser that has no moving parts.

It is a further object of the invention to provide such a can dispenser that is expandable to hold a desired number of cans therein.

It is an additional object of the invention to provide such a can dispenser that can be economically constructed using conventional manufacturing techniques.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a can dispenser, comprising: a housing including a base unit and one or more stacking units removably disposed on said 5 base unit, said base unit and said one or more stacking units defining together a plurality of vertical, arcuate, can-containing channels therein; edges of said vertical, arcuate, can-containing channels in said base unit extending to less than diameters of cans in said vertical, arcuate, can-containing channels so that said cans can be removed therefrom; and edges of said vertical, arcuate, can-containing channels in said one or more stacking units extending past diameters of cans in said vertical, arcuate, can-containing channels to hold said cans in place therein.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
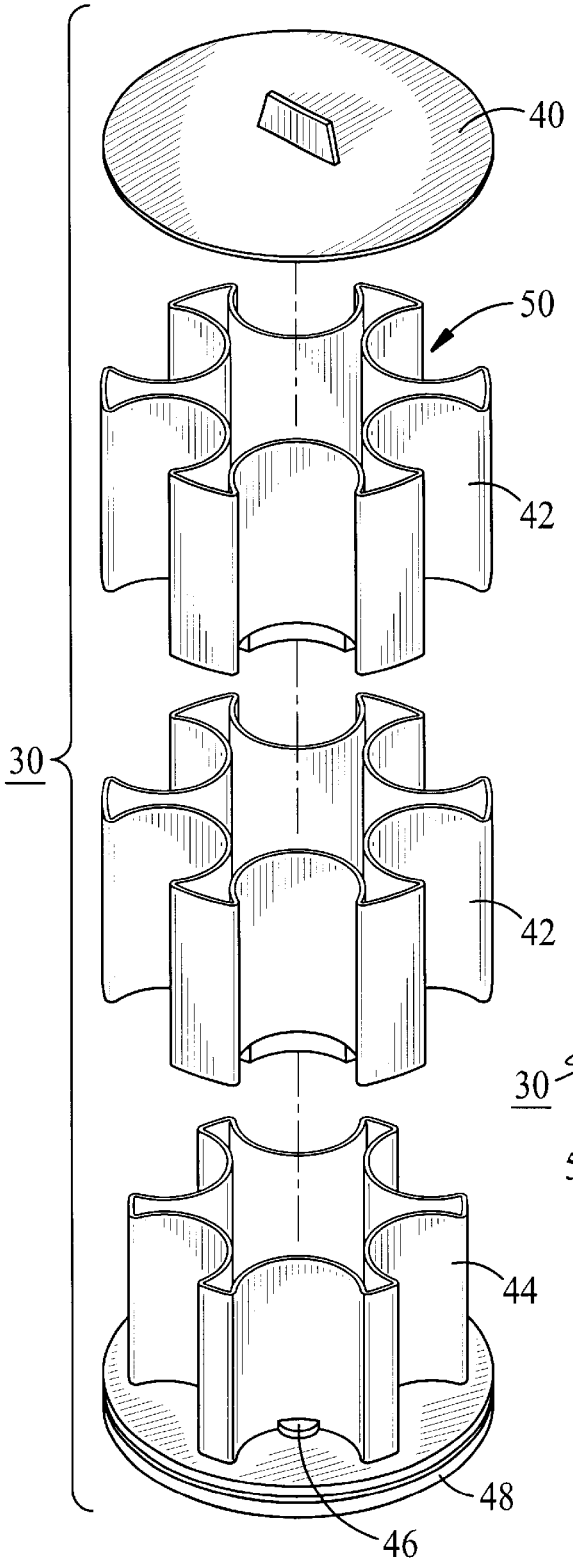
FIG. 1 is an exploded isometric view of a can dispenser constructed according to the present invention.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

FIG. 1 illustrates a can dispenser, constructed according to the present invention, and generally indicated by the reference numeral 30. The elements of can dispenser 30 shown are a lid 40, two stacking units 42 a base unit 44, with a step 46 (the purpose of which will be described in detail below), and a "lazy susan" 48 on which the horizontal circular portion of the base unit is rotatingly disposed, the latter element being disposed on a countertop (not shown), for example. Stacking units 42 and base unit 44 define a plurality of vertical channels, as at 50, into which cans may be disposed. It will be understood that any number of stacking units may be provided within the contemplation of the present invention.

Figure 2:
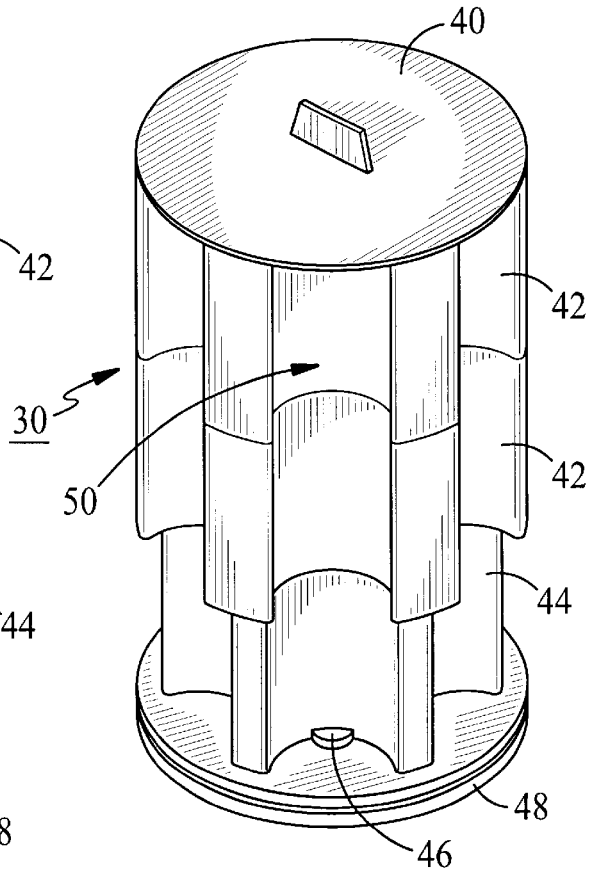
FIG. 2 is an isometric view of the can dispenser in assembled form and in which the can dispenser can hold 18 standard cans.

FIG. 2 illustrates a configuration of can dispenser 30 which can hold 18 standard cans. For purposes of this description, "standard cans" is defined as 15-ounce vegetable cans, having dimensions of about 3 inches diameter by about 4½ inches high, although the dimensions of can dispenser 30 can be modified to accommodate cans of any dimension, as will be apparent from the following description. "Short cans" as used herein are defined as cans, such as used for tuna and cat food, for example, that are about 3½ inches diameter by about 1½ inches high, although can dispenser 30 can be modified to accommodate short cans of other dimension.

Figure 3:
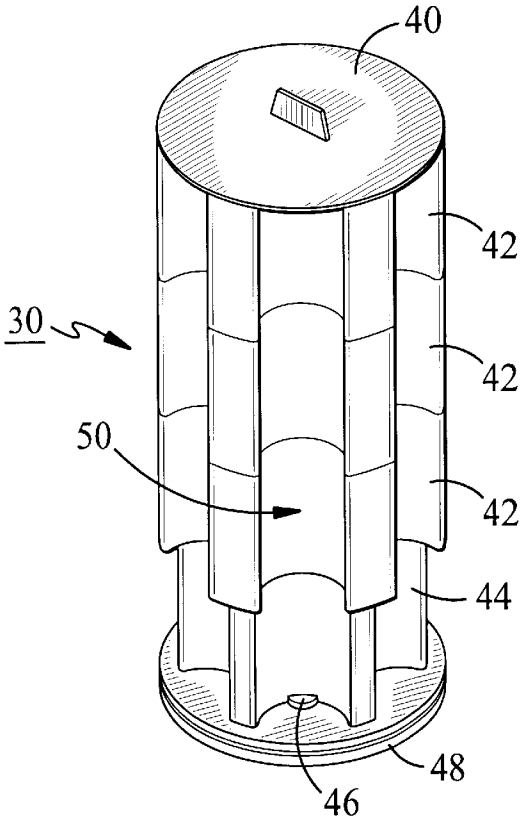
FIG. 3 is an isometric view of the can dispenser in a form that can hold 24 standard cans.

FIG. 3 illustrates that a third stacking unit 42 has been added so that can dispenser 30 can hold 24 standard cans in vertical channels 50.

Figure 4:
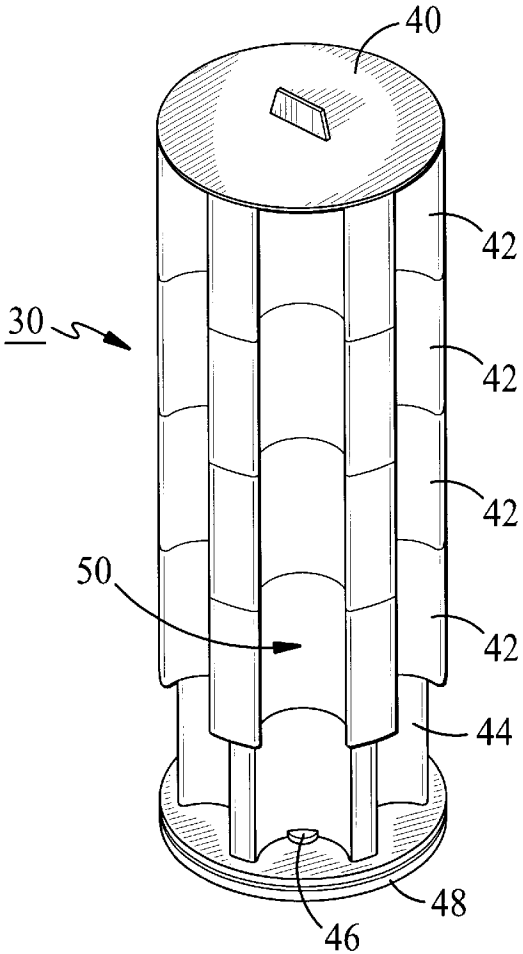
FIG. 4 is an isometric view of the can dispenser in a form that can hold 30 standard cans.

FIG. 4 illustrates that a fourth stacking unit 42 has been added so that can dispenser 30 can hold 30 standard cans in vertical channels 50.

Figure 5:
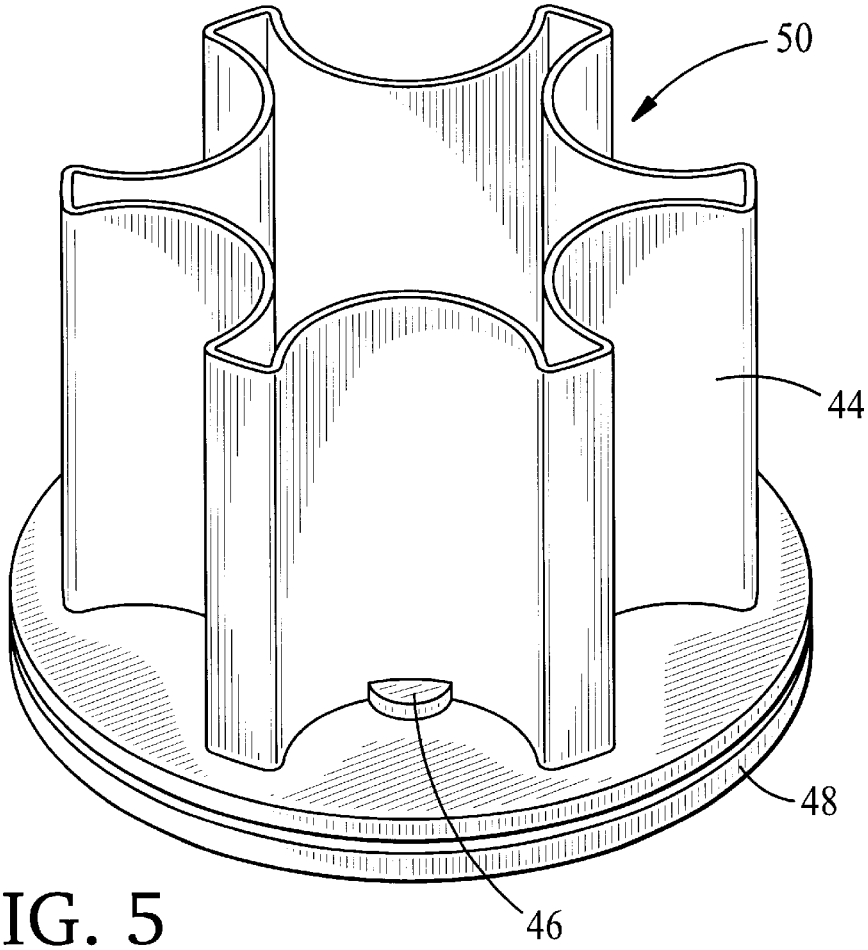
FIG. 5 is an isometric view of the base unit of a can dispenser that holds standard cans.

FIG. 5 illustrates base unit 44 configured for holding standard cans. As will be seen later, base unit 44 comprises the fluted portion, the step 46, and the circular portion, all formed integrally as a one-piece unit. Base unit 44 forms the bottoms of vertical channels 50.

Figure 6:
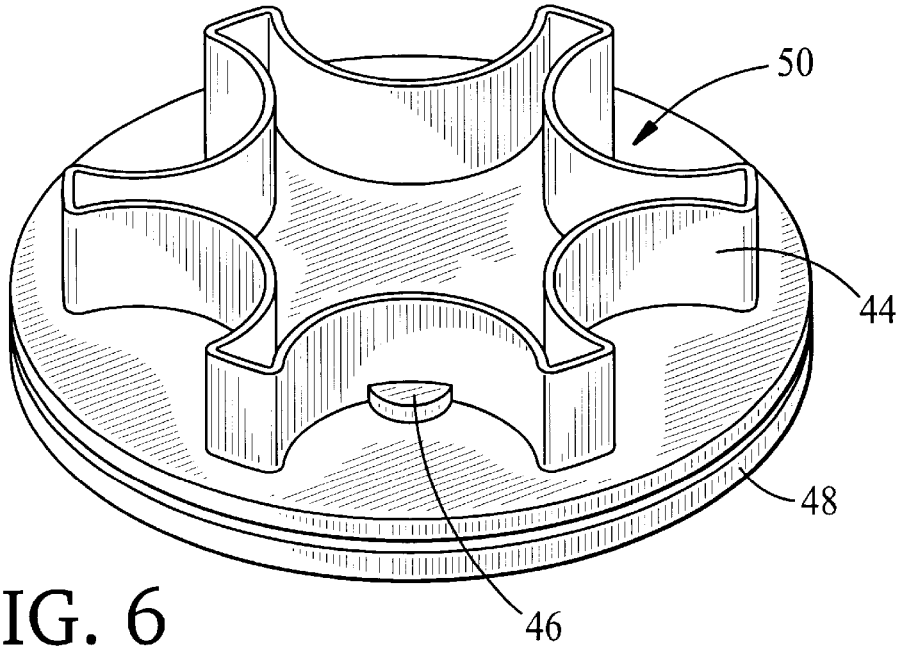
FIG. 6 is an isometric view of the base unit of a can dispenser that holds short cans.

FIG. 6 illustrates base unit 44 configured for holding short cans, the method of construction being the same as for the embodiment shown on FIG. 5.

Figure 7:
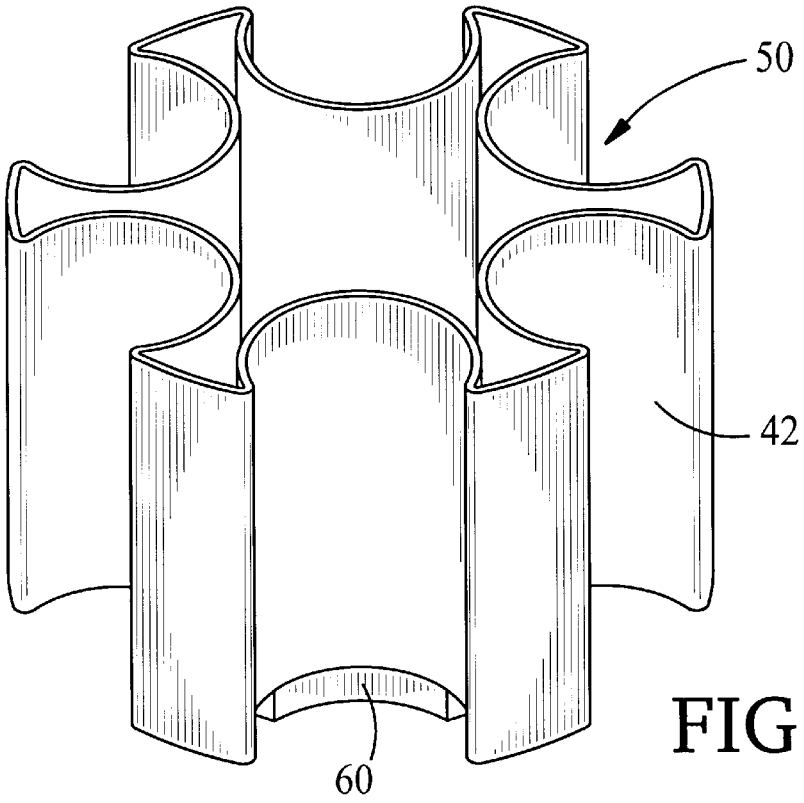
FIG. 7 is an isometric view of a stacking unit of the can dispenser showing the top of the stacking unit.

FIG. 7 illustrates a stacking unit 42 with an integral key interlock 60, the latter element being configured to removably fit into the complementarily shaped top portion of base unit 44 (FIG. 5) or into the complementarily shaped top portion of another stacking unit. Stacking unit 42 and key interlock 60 are formed integrally as a one-piece unit.

Figure 8:
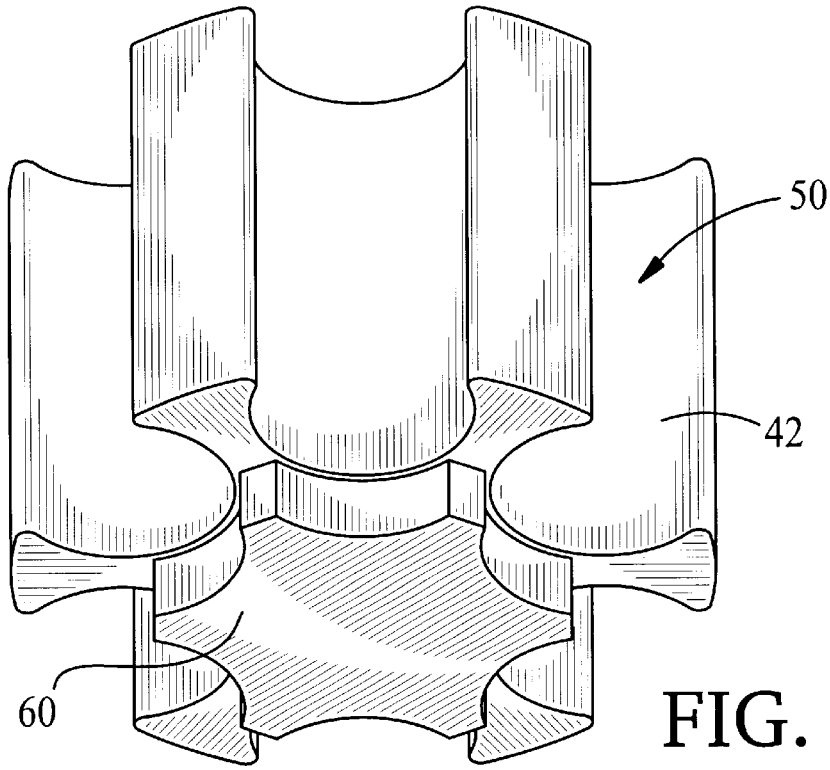
FIG. 8 is an isometric view of the stacking unit of the can dispenser showing the bottom and the integral key interlock of the stacking unit.

FIG. 8 illustrates another view of stacking unit 42, more clearly showing the key interlock 60.

It can be seen from inspection of the figures presented so far, FIGS. 1–8, that can dispenser 30 can be configured to hold a desired number of cans and such can be accomplished, for example, by a homeowner adding to or subtracting from the number of stacking units 42 provided (FIGS. 2–4). No adhesive or other permanent attaching means is required.

Figure 9:
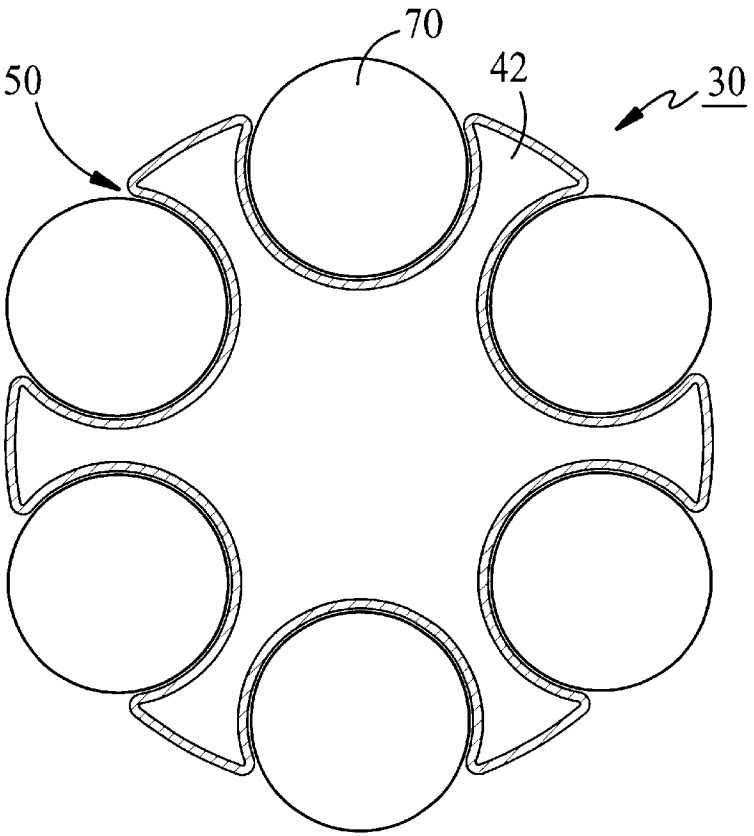
FIG. 9 is a top plan view of a stacking unit of the can dispenser.

FIG. 9 illustrates can dispenser 30 with lid 40 (FIG. 2) removed and filled with a plurality of cans, as at 70. It is to be noted from inspection of FIG. 9 that the edges of stacking unit 42 extend past the diameters of cans 70 to hold the cans securely in place in channels 50, but preferably not so far that the contents of cans 70 cannot be visually ascertained.

Figure 10:
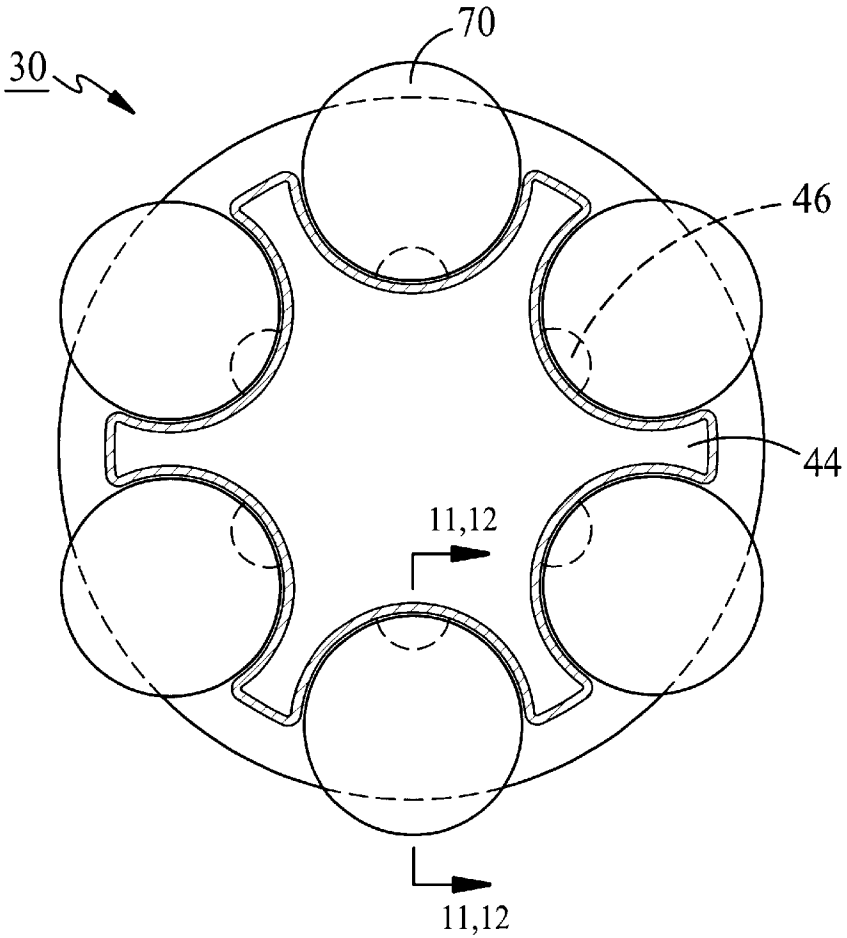
FIG. 10 is a top plan view of the base unit of the can dispenser.

FIG. 10 illustrates base unit 44 of can dispenser 30 with cans 70 disposed therein. It is to be noted from inspection of FIG. 9 that the edges of base unit 44 extend to less than the diameters of cans 70 for ease of removal of the cans from can dispenser 30.

Figure 11:
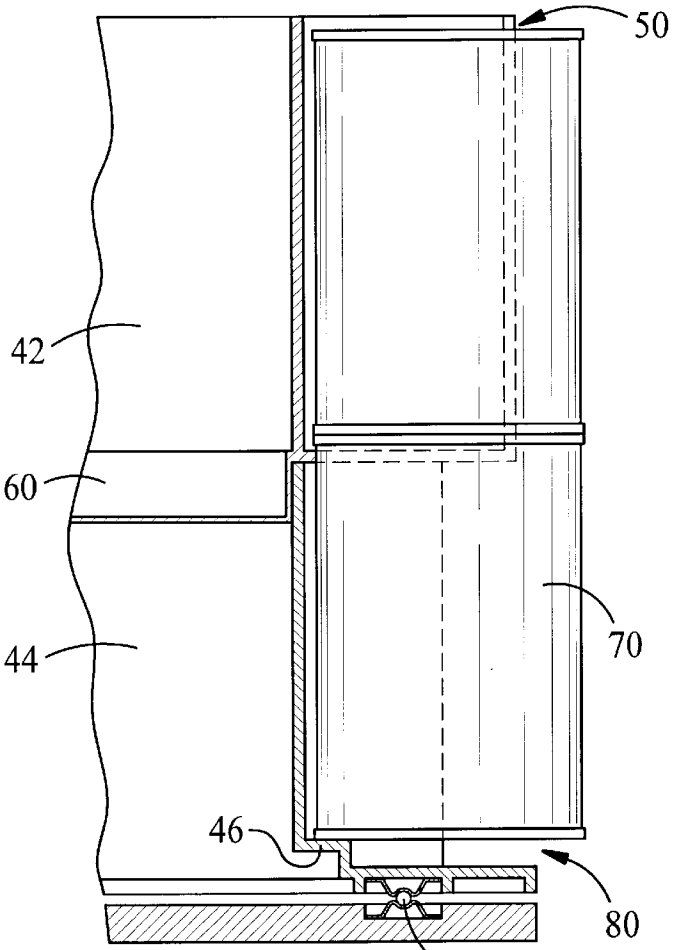
FIG. 11 is a fragmentary, side elevational view, partially in cross- section, of the lower end of the can dispenser, taken along line 11—11, 12—12 of FIG. 10.

FIG. 11 illustrates that the edge of lowermost of cans 70 rests on step 46 such that a clearance 80 is formed between the bottom of the lowermost of the cans and the horizontal circular portion of base unit 44. It is to be noted from inspection of FIG. 11 that the top of lowermost can 70 extends slightly into the lowermost stacking unit so that the lowermost can is held securely in place. A circular bearing structure 90 locks the horizontal circular portion of base unit 44 onto lazy susan 48.

Figure 12:
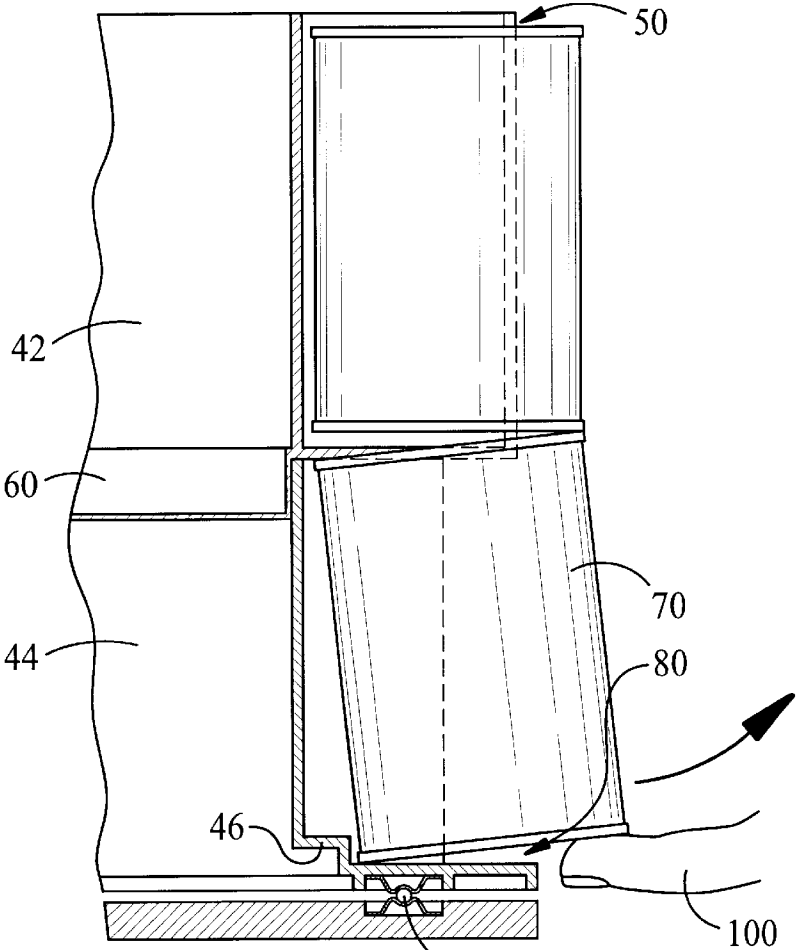
FIG. 12 is a fragmentary, side elevational view, partially in cross-section, of a standard can being removed from the can dispenser, taken along line 11—11, 12—12 of FIG. 10.

FIG. 12 illustrates that a finger 100 of a user (not otherwise shown) can be inserted into clearance 80 to rotate lowermost can 70 outwardly to a point where the sides of the lowermost can can be grasped by the user and the lowermost can can then be removed from can dispenser 30. After removal of the lowermost of cans 70, the other cans drop down and the next lowermost can in channel 70 becomes the lowermost can disposed in base unit 44.

Figure 13:
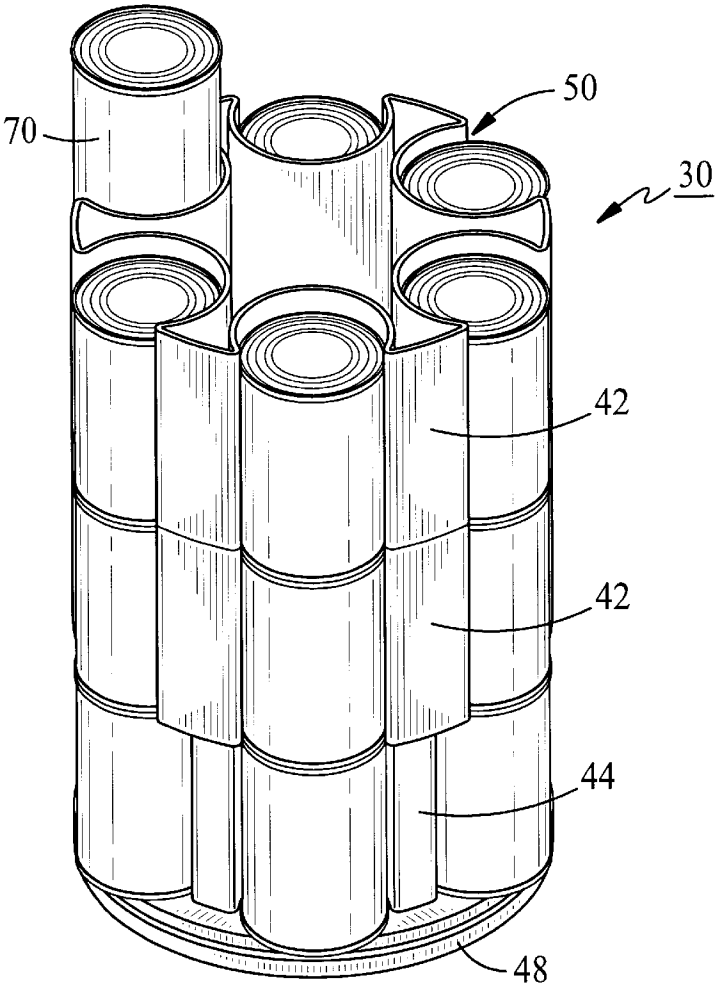
FIG. 13 is an isometric view of the can dispenser with the top thereof removed and a standard can being inserted into one of the channels thereof.

FIG. 13 illustrates can dispenser 30, with two stacking units 42, filled with standard cans, except for a can 70 that is being inserted into one of channels 50. For this operation, of course, lid 40 (FIG. 2) must be removed.

Figure 14:
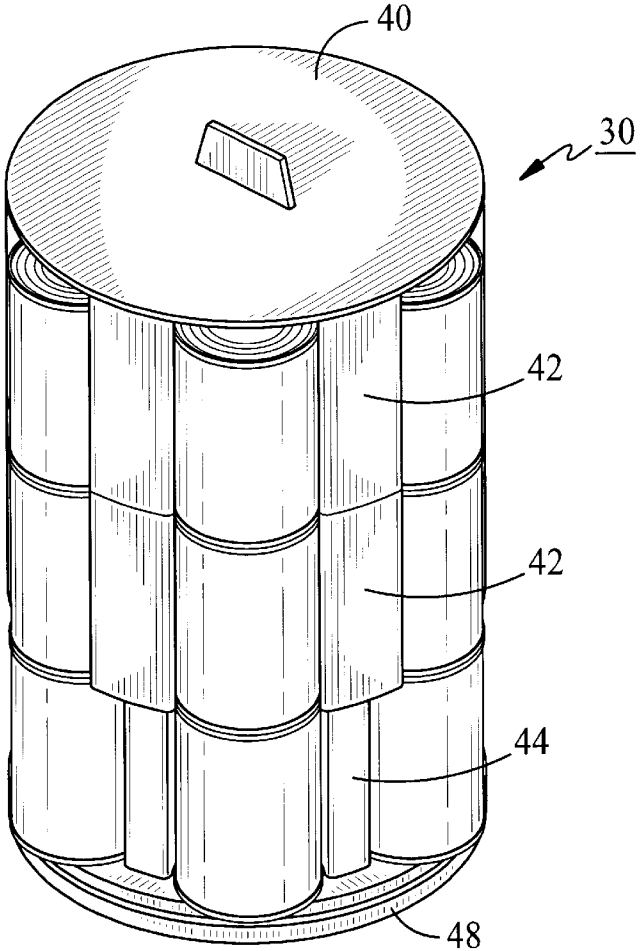
FIG. 14 is an isometric view of the can dispenser with standard cans inserted into the channels thereof.

FIG. 14 illustrates can dispenser 30 filled with standard cans and with lid 40 in place on the can dispenser.

Figure 16:
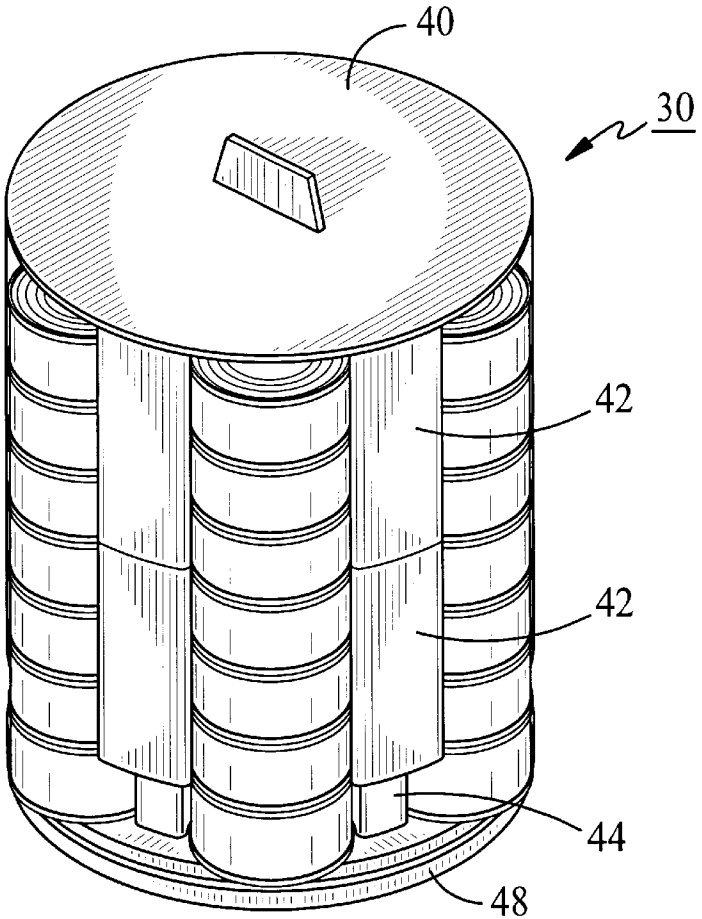
FIG. 16 is an isometric view of an assembled can dispenser holding short cans.
Figure 15:
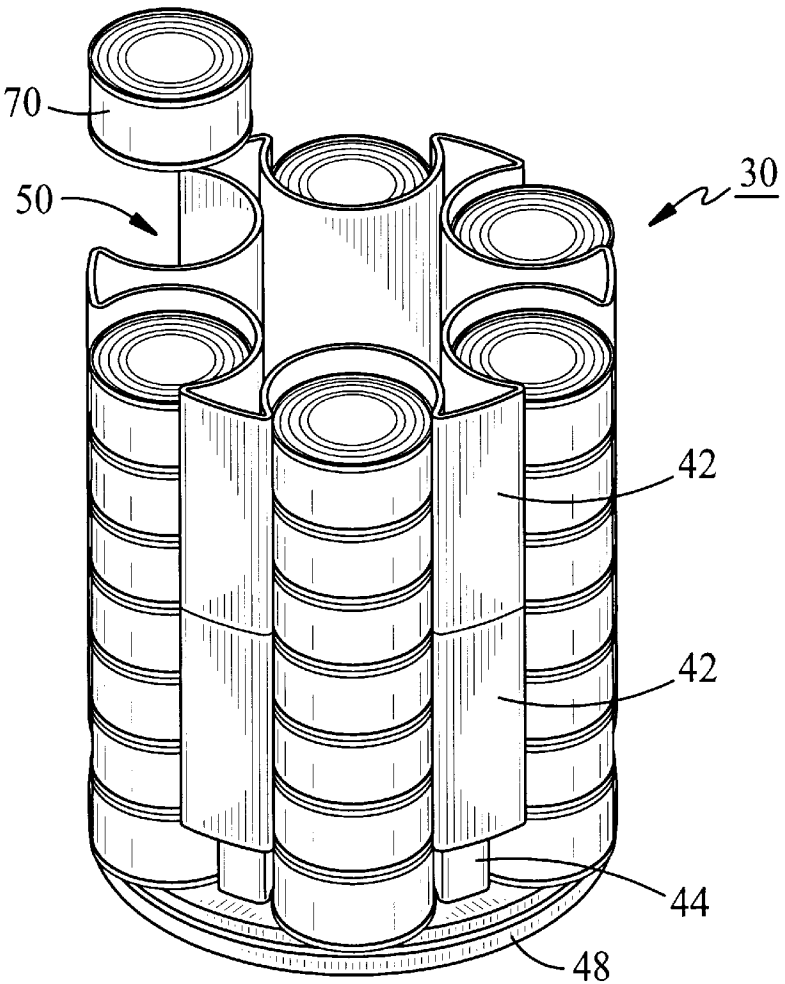
FIG. 15 is an isometric view of the can dispenser, with the top thereof removed, holding short cans, and with a short can being inserted into one of the channels thereof.

FIGS. 15 and 16 are similar to FIGS. 13 and 14, except that can dispenser 30 has been filled with short cans 70. In the embodiment shown, one short can is disposed in base unit 44, while six short cans are disposed in each of channels 50 defined by two stacking units 42. In this manner, stacking units 42 may be used for either short cans 70 shown or for standard cans 70 having diameters similar to those of the short cans.

Figure 17:
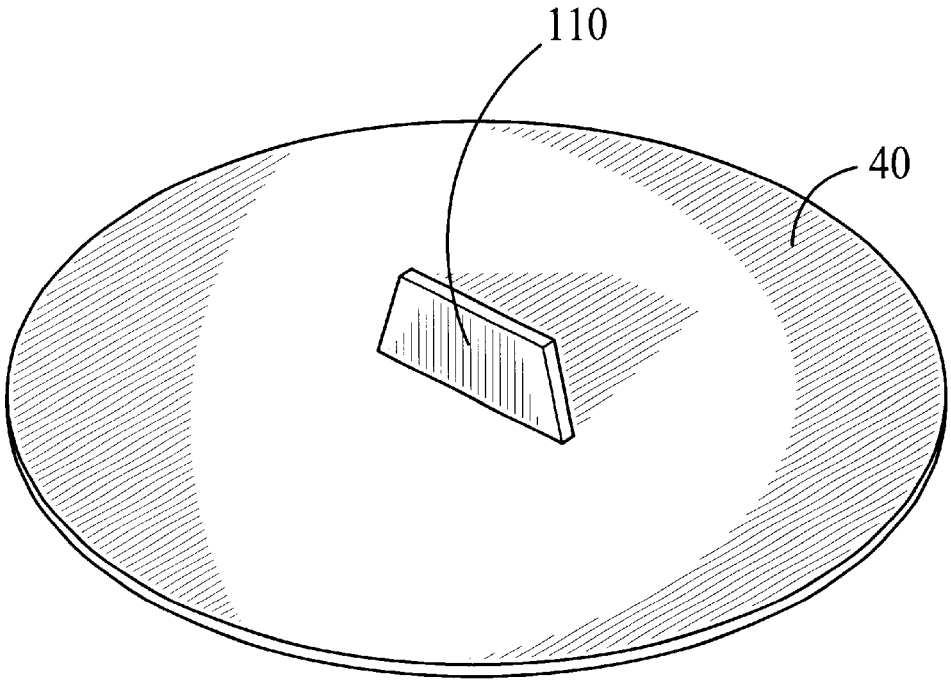
FIG. 17 is a top plan view of the lid of the can dispenser.

FIG. 17 illustrates lid 40 with a centrally disposed lifting tab 110.

Figure 18:
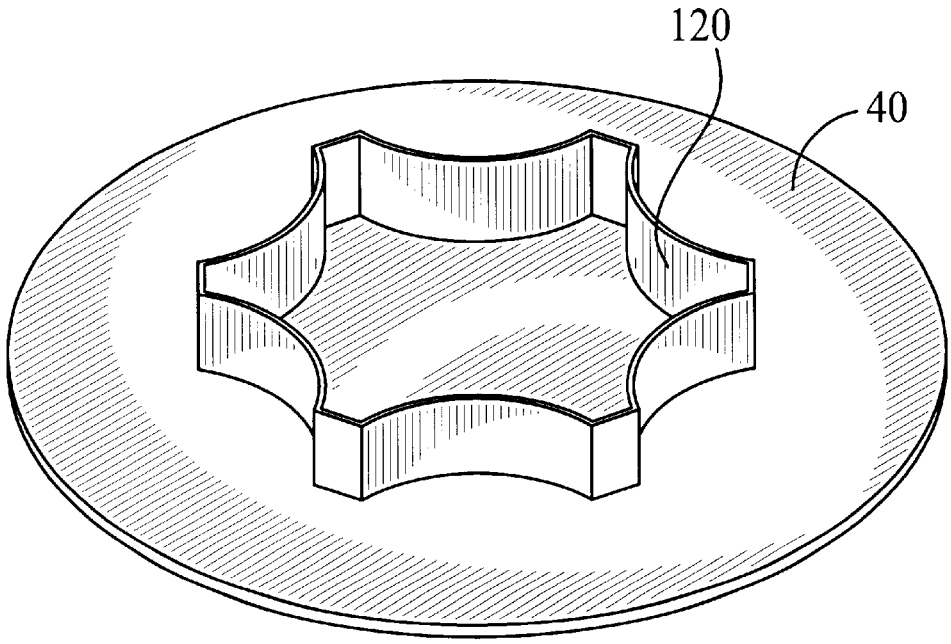
FIG. 18 is a bottom plan view of the lid of the can dispenser showing the integral key interlock.

FIG. 18 illustrates a bottom view of lid 40 and shows an integral key interlock 120 that fits into the complementarily shaped top portion of the topmost stacking unit (FIG. 1). Lid 40, lifting tab 110 (FIG. 17), and key interlock 120 are integrally formed of a single piece of material.

The elements of can dispenser 30, save for bearing structure 90 which ordinarily would be metallic, can be economically molded from a suitable thermoplastic material using conventional manufacturing techniques. Other materials can be employed as well, if desired.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. A can dispenser, comprising:

(a) a housing including a base unit and one or more stacking units removably disposed on said base unit, said base unit and said one or more stacking units defining together a plurality of vertical, arcuate, can-containing channels therein;

(b) edges of said vertical, arcuate, can-containing channels in said base unit extending a distance equal to less than half of the circumference of cans to be placed in said vertical, arcuate, can-containing channels so that said cans to be placed in said vertical, arcuate, can-containing channels can be removed therefrom;

(c) edges of said vertical, arcuate, can-containing channels in said one or more stacking units extending a distance equal to greater than half the circumference of cans to be placed in said vertical, arcuate, can-containing channels to hold said cans to be placed in said vertical, arcuate, can-containing channels in place therein; and (d) a lowermost stacking unit has formed on a bottom thereof a key interlock that removably fits into a complementarily shaped upper portion of said base unit to removably lock said lowermost stacking unit in place on said base unit, said key interlock being the sole apparatus for attaching said lowermost stacking unit to said base unit.

2. A can dispenser, as defined in claim 1, wherein: a stacking unit adjacent said lowermost stacking unit has formed on a bottom thereof a key interlock that removably fits into a complementarily shaped upper portion of said lowermost stacking unit to removably lock said stacking unit adjacent said lowermost stacking unit in place on said lowermost stacking unit, said key interlock being the sole apparatus for attaching said stacking unit adjacent said lowermost stacking unit to said lowermost stacking unit.

3. A can dispenser, as defined in claim 1, further comprising: a lid having formed on a bottom thereof a key interlock that removably fits inside a complementarily shaped upper portion of an uppermost stacking unit to hold said lid in place on said uppermost stacking unit.

4. A can dispenser, as defined in claim 1, further comprising: a semi-circular step formed on said base unit on which said step an edge of a lowermost can to be placed in one of said vertical, arcuate, can-containing channels rests to form a space underneath said lowermost can to be placed in one of said vertical, arcuate, can-containing channels into which space a user can insert a finger against a bottom of said lowermost can to be placed in one of said vertical, arcuate, can-containing channels to rotate said can partially out of said one of said vertical, arcuate, can-containing channels.

5. A can dispenser, as defined in claim 4, wherein: a top portion of said lowermost can is disposed in a lowermost stacking unit to secure said lowermost can in place.

6. A can dispenser, as defined in claim 1, wherein: said base unit rotatingly rests on a turntable.

* * * * *